US008230613B2

(12) United States Patent
Moon et al.

(10) Patent No.: US 8,230,613 B2
(45) Date of Patent: Jul. 31, 2012

(54) CLOTHES TREATING APPARATUS

(75) Inventors: Jung Wook Moon, Changwon-si (KR); Dae Yun Park, Changwon-si (KR); Sog Kie Hong, Changwon-si (KR); Jong Seok Kim, Changwon-si (KR); Seung Gyu Ryu, Changwon-si (KR); Hye Yong Park, Changwon-si (KR); Chang Gyu Choi, Changwon-si (KR); Dong Won Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 725 days.

(21) Appl. No.: 12/320,705

(22) Filed: Feb. 2, 2009

(65) Prior Publication Data

US 2009/0260250 A1 Oct. 22, 2009

Related U.S. Application Data

(63) Continuation-in-part of application No. PCT/KR2008/004510, filed on Aug. 4, 2008.

(30) Foreign Application Priority Data

Aug. 3, 2007 (KR) ..... 10-2007-0078121

(51) Int. Cl.

| | |
|---|---|
| ***F26B 21/06*** | (2006.01) |
| ***F26B 3/00*** | (2006.01) |
| ***F04F 1/18*** | (2006.01) |
| ***F16T 1/34*** | (2006.01) |
| ***F25D 21/14*** | (2006.01) |

(52) U.S. Cl. ..... 34/79; 137/207.5; 137/171; 62/285; 62/288; 34/469

(58) Field of Classification Search ..... 34/202, 34/75, 79; 122/34, 18.1, 15.1, 31.1, 31.2; 137/20, 207.5, 203, 171, 177, 312, 314; 62/272, 62/285, 288, 291; 165/110, 117, 118; 202/180, 202/185.1, 202, 197; 141/286; 203/40
See application file for complete search history.

(56) References Cited

U.S. PATENT DOCUMENTS

| | | | | |
|---|---|---|---|---|
| 4,096,876 | A * | 6/1978 | Ulrich | 137/185 |
| 5,000,765 | A * | 3/1991 | Nelson | 96/220 |
| 5,203,258 | A * | 4/1993 | Tippmann et al. | 99/483 |
| 5,546,678 | A | 8/1996 | Dhaemers | |
| 5,675,919 | A * | 10/1997 | Yao | 38/77.6 |
| 6,425,192 | B2 | 7/2002 | Arrieta et al. | |
| 2008/0034813 | A1 | 2/2008 | Tobias | |
| 2008/0155757 | A1 | 7/2008 | Kim et al. | |
| 2010/0083532 | A1 * | 4/2010 | Klug et al. | 34/597 |

FOREIGN PATENT DOCUMENTS

| | | |
|---|---|---|
| EP | 1 734 170 | 12/2006 |
| ES | 2281239 | 9/2007 |
| ES | 2281239 A1 * | 9/2007 |
| GB | 2 428 692 | 2/2007 |
| WO | WO 2004-091359 | 10/2004 |

* cited by examiner

*Primary Examiner* — Kenneth Rinehart
*Assistant Examiner* — John McCormack
(74) *Attorney, Agent, or Firm* — McKenna Long & Aldridge LLP

(57) ABSTRACT

A clothes treating apparatus is disclosed. The clothes treating apparatus includes a cabinet in which an accommodating space for receiving clothes is defined, a steam generator for generating steam to be supplied into the accommodating space, and a supply unit for supplying the steam, generated in the steam generator, into the receiving space and collecting water condensed from the steam.

9 Claims, 6 Drawing Sheets

CLOTHES TREATING APPARATUS

This application is a Continuation-In-Part based on International Application PCT/KR2008/004510 filed on Aug. 4, 2008, and claims benefit under 35 U.S.C. §365(c) of the filing date of Korean Patent Application No. 10-2007-0078121, filed on Aug. 3, 2007, both of which are hereby incorporated by reference in their entireties for all purposes as if fully set forth therein.

The present invention relates to a clothes treating apparatus, and more particularly, to a clothes treating apparatus capable of more effectively freshening clothes.

BACKGROUND ART

Recently, various types of clothes treating apparatuses have been introduced, together with a washing machine for washing clothes. For example, the following clothes drying machines have been developed: a drum-type machine for drying washed clothes, a cabinet type drying machine for drying clothes hanging therein, a freshener for freshening clothes by supplying hot air to the clothes, and the like.

Of the various types of clothes treating apparatuses, in particular, a freshener, a drying machine, or the like, act mainly to heat air using heaters to supply hot air to clothes. Heaters may be classified, for example, into gas heaters for heating air via combustion of gas, and electric heaters for heating air using electrical resistance. In recent years, electric heaters are increasingly used because of their simplified configuration and convenience of installation.

However, when heating air using the above-described electric heaters, high-temperatures generated by the heaters may be directly transferred to the clothes. This causes damage to the clothes and in a worst case, may cause ignition of a fire in a clothes treating apparatus. Furthermore, the electric heaters heat air using electric power, therefore, heating air to a desired temperature requires enormous consumption of electric power and consequently, expensive operating costs for clothes treating apparatuses.

SUMMARY OF THE INVENTION

The present invention provides a clothes treating apparatus that obviates one or more of the aforementioned problems due to limitations in the prior art.

An object of the present invention is to reduce consumption of electric energy and achieve a simplified configuration a clothes treating apparatus.

Another object of the present invention is to prevent unwanted ejection of condensate water when steam is ejected to freshen clothes.

In accordance with one aspect of the present invention, the aforementioned and other objects may be achieved by a clothes treating apparatus that includes a cabinet defining an accommodating space adapted to receive clothes; a steam generator adapted to generate steam to be supplied into the accommodating space; and a supply unit adapted to supply the steam into the accommodating space and to collect water condensed from the steam.

In accordance with another aspect of the present invention, the aforementioned and other objects may be achieved by a clothes treating apparatus that includes a cabinet that defines an accommodating space adapted to receive clothes. The apparatus also includes a steam generator, a steam supply hose, a water collecting hose and a supply unit. The supply unit includes at least one opening adapted to disperse steam into the accommodating space. The apparatus further includes a water collection part adapted to guide condensed water into the water collecting hose, wherein the steam supply hose directs steam from the steam generator through a steam introduction port into the supply unit, the steam introduction port positioned relative to the water collecting hose such that condensed water, flowing along a water collecting path, does not interfere with steam flowing along a steam supply path in the supply unit.

BRIEF DESCRIPTION OF DRAWINGS

The accompanying drawings, which are included to provide a further understanding of the invention, illustrate embodiments of the invention and together with the description serve to explain the principle of the invention.

In the drawings.

DETAILED DESCRIPTION

Reference will now be made in detail to the preferred embodiments of the present invention, examples of which are illustrated in the accompanying drawings.

Figure 1:
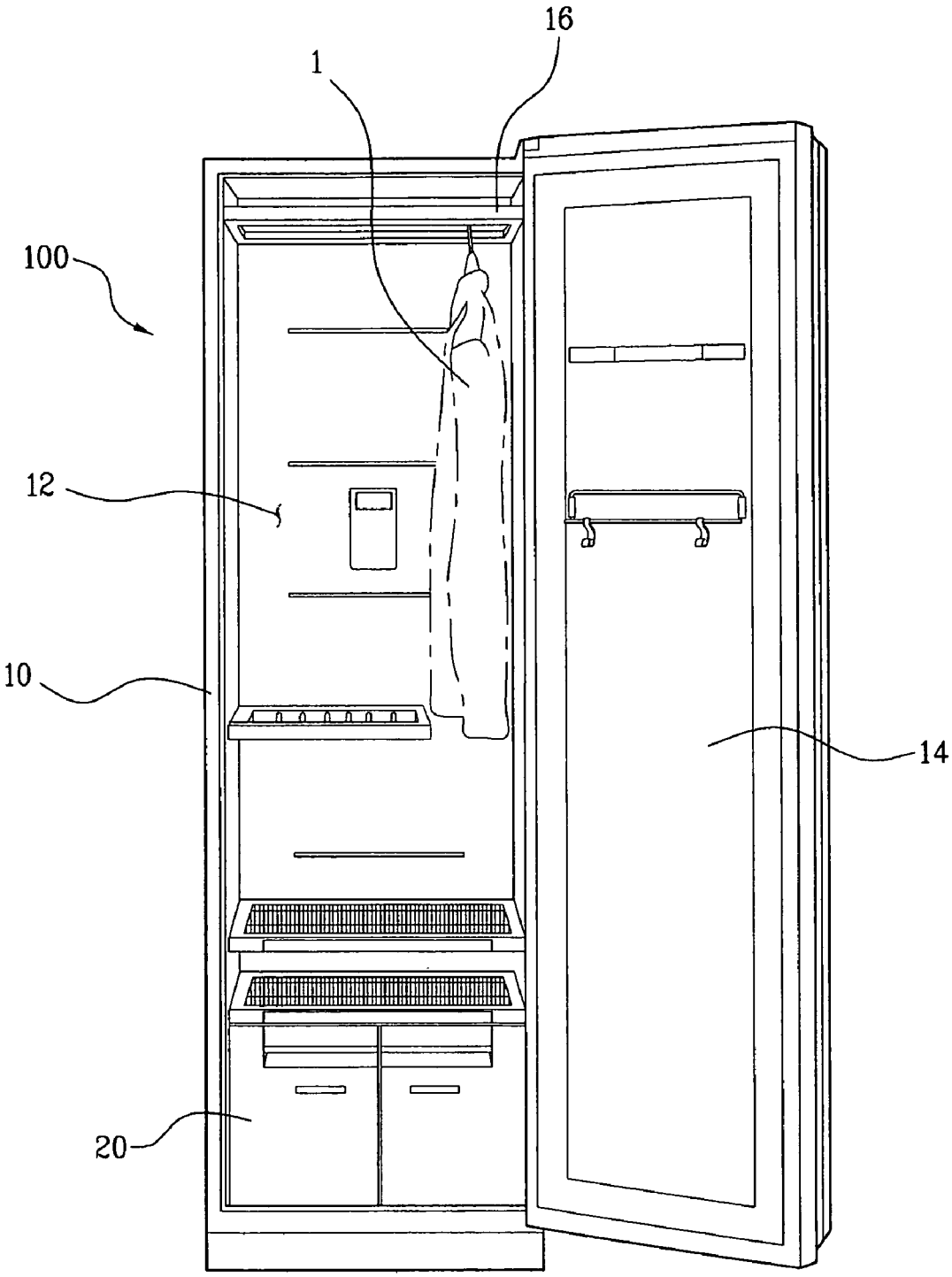
FIG. 1 is a front view of a clothes treating apparatus according to a preferred embodiment of the present invention.

FIG. 1 is a front view of a clothes treating apparatus according to a preferred embodiment of the present invention. It is noted that the clothes treating apparatus according to the present invention will be described herein as a freshener for freshening clothes by supplying hot air to the clothes, but the present invention is not limited thereto, and the feature of the present invention is also applicable to other types of clothes treating apparatuses employing a heat pump and a steam generator which will be described hereinafter.

Referring to FIG. 1, the clothes treating apparatus 100 according to the present invention includes a cabinet 10 in which an accommodating space 12 for receiving and accommodating clothing 1 is defined, an air supplier 22 (See FIG. 2) which supplies dry air into the accommodating space 12, a steam generator 30 (See FIG. 2) which selectively ejects steam into the accommodating space 12, and a steam supply unit 40 (See FIG. 2) which ejects steam generated in the steam generator 30 into the accommodating space 12 and collects condensate water condensed during movement of steam.

The cabinet 10, defining the accommodating space 12 for receiving and accommodating clothing, incorporates a variety of constituent elements which will be described hereinafter. Specifically, the cabinet 10 is provided with a door 14, to selectively communicate the accommodating space 12 with the outside. Also, a variety of supporting structures 16, on which the clothing 1 can be hung, may be installed in the accommodating space 12. The configuration of hanging the clothes 1 is well known in the art of the invention and thus, a detailed description thereof will be omitted.

The cabinet 10 is further defined therein with a mechanism compartment 20, in which the air supplier 22 for supplying dry air and the steam generator 30 for selectively generating and supplying steam into the accommodating space 12, are disposed. The mechanism compartment 20 may preferably be located below the accommodating space 12, and the air supplier 22, the steam generator 30, and similar mechanical component may be arranged in the mechanism compartment 20. The reason why the mechanism compartment 20 is preferably located below the accommodating space 12 so that dry air, steam, and the like supplied into the accommodating space 12 naturally rises. Therefore, as the hot air, steam and the like are generated in the mechanism compartment 20, it is preferably located below the accommodating space 12 so as to supply the dry air and steam upward.

Figure 2:
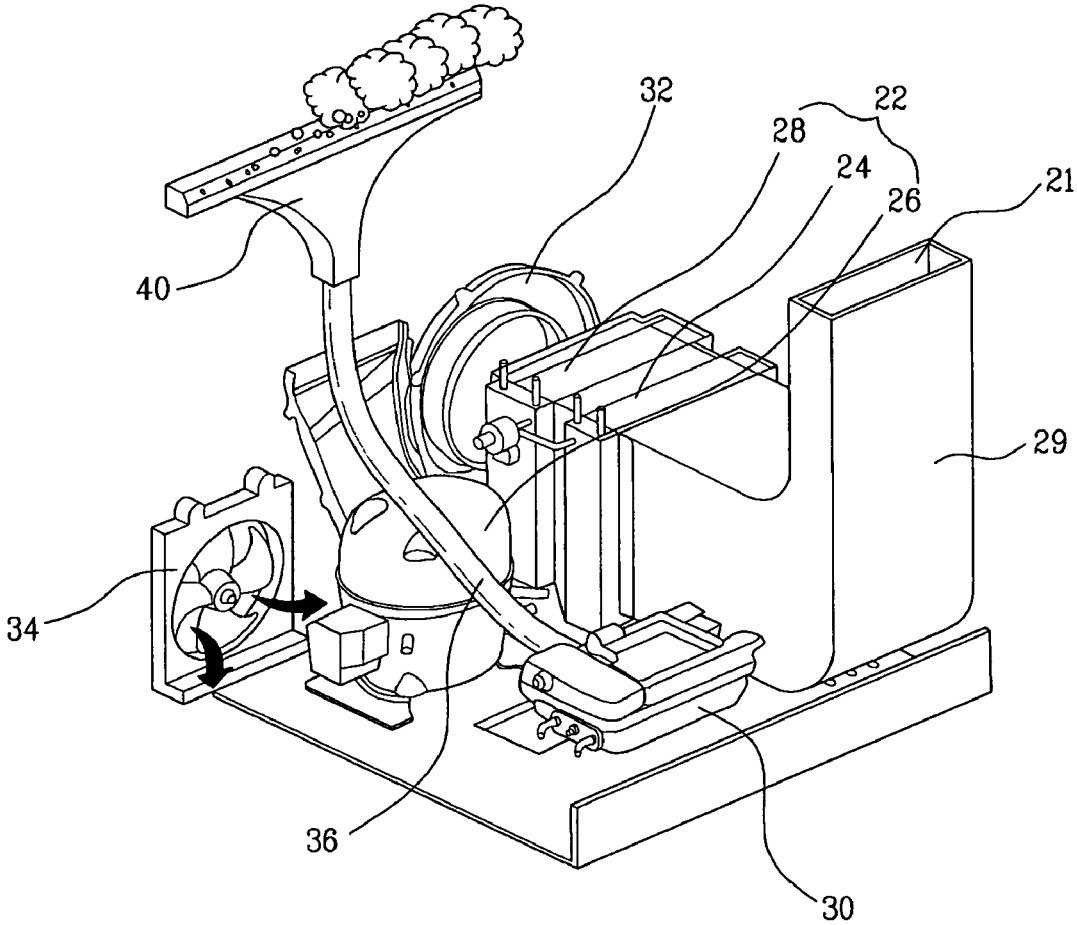
FIG. 2 is a perspective view illustrating the interior of a mechanism compartment shown in FIG. 1.

FIG. 2 is a perspective view schematically illustrating the interior of the mechanism compartment 20. For convenience of description, FIG. 2 illustrates o the air supplier 22 and the steam generator 30, however, piping lines connecting the same are not illustrated.

Referring to FIG. 2, in the present invention, the air supplier 22 for supplying dry air into the receiving space 12 (See FIG. 1) includes a heat pump 22. Both the heat pump 22 and the steam generator 30 are arranged in the mechanism compartment 20.

The heat pump 22, which serves as the air supplier in the present invention, is similar to a heat pump for use in an air conditioner, and the like. Specifically, the heat pump 22 includes an evaporator 24, a compressor 26, a condenser 28, and an expansion valve (not shown), which constitute a refrigerant circulation cycle, and perform dehumidification and heating of air via the refrigerant circulation cycle. More specifically, as a refrigerant absorbs latent heat of the surrounding air while being evaporated in the evaporator 24, the air is cooled and also, moisture contained in the air is condensed and removed. Further, when the refrigerant having passed through the compressor 26 is condensed in the condenser 28, the refrigerant emits the latent heat toward the surrounding air, thereby heating the surrounding air. Accordingly, the evaporator 24 and the condenser 28 function as a heat exchanger, causing the air introduced into the mechanism compartment 20 to be dehumidified and heated as it passes through the evaporator 24 and the condenser 28 in sequence. In this way, the resulting dry and hot air may be supplied into the accommodating space 12.

As described above, the air supplier 22 may serve not only to heat air, but also to dehumidify air without using a separate dehumidifier. Accordingly, the air supplier 22 according to the present invention can supply dehumidified air without a separate dehumidifier, and this enables easy drying and freshening of clothes.

The mechanism compartment 20 has an air inlet 21 formed at an upper front end position thereof, through which the interior air of the accommodating space 12 is introduced into the mechanism compartment 20. Preferably, a duct 29 is provided to define an air flow passage for fluidly connecting the air inlet 21, evaporator 24, condenser 28 and fan 32 with one another. Once the air is introduced through the air inlet 21 into the mechanism compartment 20 and is directed along the duct 29, the air is dehumidified and heated while passing through the air supplier 22, and then, is again supplied into the accommodating space 12 via operation of the fan 32.

Although not shown in the drawings, the air inlet 21 may preferably provided with a filter. The filter provided at the air inlet 21 removes a variety of impurities contained in the air being introduced from the accommodating space 12 into the mechanism compartment 20, thereby allowing only fresh air to be supplied into the accommodating space 12.

The steam generator 30 is installed in the mechanism compartment 20, to selectively supply steam into the accommodating space 12. Supplying the steam into the accommodating space 12 via operation of the steam generator 30 enables removal of wrinkles, etc. that may be present in clothes. Moreover, the high-temperature steam yields not only sterilizing effects, but also freshening effects through, for example, swelling of clothes fabric. A supplying time of steam from the steam generator 30 may be varied appropriately depending upon the desired effects. Preferably, steam may be ejected prior to supplying dry air using the above-described air supplier 22. This is because drying the clothing by supplying dry air to the accommodating space 12 after introduction of the high-temperature steam is preferable.

The steam generator 30 incorporates a heater (not shown) to heat water received therein. If steam is generated via heating of water, the steam generator 30 supplies the steam into the accommodating space 12. A water supply source for supplying water into the steam generator 30 may be an external water tap, or may be a water container installed in the mechanism compartment 20. Preferably, the water container is detachably installed, to allow a user to separate the water container from the mechanism compartment 20 to fill it with water and then replace the filled water container.

The steam generated in the steam generator 30 may be supplied into the receiving space 12 through a steam hose 36 and a supply unit 40. In this case, a shorter steam hose 36 may be more preferable so as to prevent the steam from dropping in temperature condensing as it passes along the steam hose 36. Accordingly, in the case where the mechanism compartment 20 is located below the accommodating space 12, it is preferred that the supply unit 40 be positioned to supply the steam through the top of the mechanism compartment 20, i.e. through the bottom of the accommodating space 12.

The mechanism compartment 20 may be provided, at a rear surface thereof, with a circulating fan 34. The circulating fan 34 supplies outside air into the mechanism compartment 20, to prevent the interior temperature of the mechanism compartment 20 from rising excessively due to operation of the above-described heat pump 22 and steam generator 30.

Meanwhile, in the clothes treating apparatus having the above-described configuration, even if the steam hose 36 has a short length, it is difficult to completely prevent the steam from condensing while moving along the steam hose 36. At least a part of the steam generated in the steam generator 30 is condensed while moving along the steam hose 36, resulting in condensate water. If the condensate water, condensed from the steam, is supplied into the accommodating space 12 together with the steam, the clothes contained therein are dampened, causing deterioration in freshening effect and propagation of bacteria, etc. within the clothes treating apparatus. For this reason, it is necessary to collect the condensed water during the steam supply, so as not to supply the condensate water into the accommodating space 12.

In consideration of the above-described requirement, the clothes treating apparatus according to the present invention includes the supply unit 40 for ejecting the steam generated in the steam generator 30 into the receiving space 12 and collecting the water condensed during movement of the steam. Hereinafter, a detailed configuration of the supply unit 40 will be described with reference to the drawings.

Figure 3:
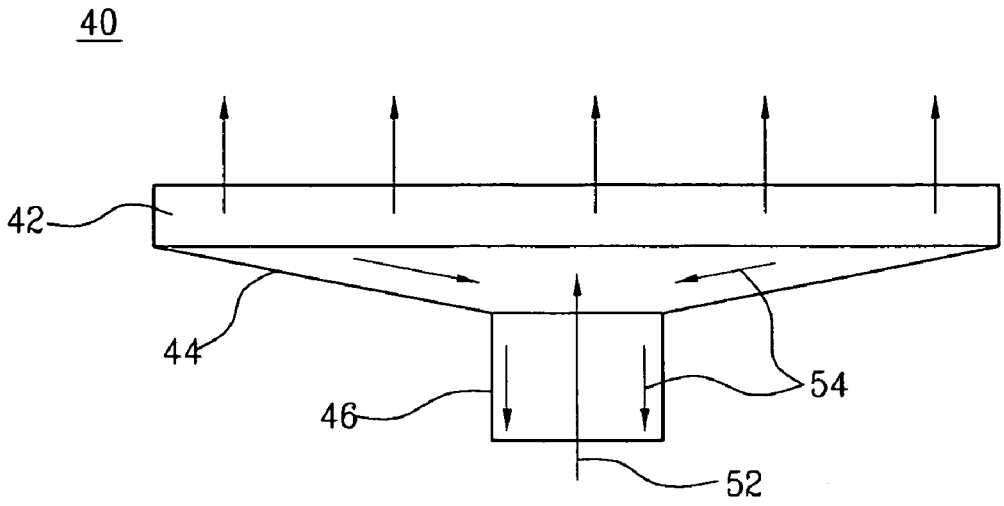
FIG. 3 is a schematic view illustrating a configuration of a supply unit shown in FIG. 2 according to a first embodiment.

FIG. 3 is a view schematically illustrating a configuration of the supply unit provided in the clothes treating apparatus according to a first embodiment of the present invention.

Referring to FIG. 3, the supply unit 40 according to the present embodiment includes a supply portion 42 for the ejection of steam, and a water collecting portion 44 having a water collecting path 54 formed at an inner peripheral surface thereof for the collection of condensate water.

Specifically, the steam is ejected from the supply portion 42 into the accommodating space 12. As described above, the supply portion 42 is located underneath the accommodating space 12 and ejects steam upward.

The water collecting portion 44 may be tapered downward from an end of the supply portion 42 at a predetermined angle. With a tapered configuration of the water collecting portion 44, the water collecting path 54 for the collection of condensate water is defined at the inner peripheral surface of the water collecting portion 44. Specifically, even if steam is condensed in the supply portion 42 and the water collecting portion 44 to thereby cause condensate water, the condensate water flows along the tapered inner peripheral surface of the water collecting portion 44. In this way, the inner peripheral surface of the water collecting portion 44 defines the water collecting path 54, along which the condensed water flows.

The supply unit 40 may further include a connecting portion 46, which is provided at a lower end of the water collecting portion 44 and is connected to the steam hose 36 of the steam generator 30.

The connecting portion 46 has a supply path 52 for the supply of steam, and the water collecting path 54 for the collection and movement of condensate water is also formed at the connecting portion 46. More specifically, the steam supplied along the steam hose 36 rises through the center of the connecting portion 46 and thus, the supply path 52 for the supply of steam is defined in the center of the connecting portion 46. Also, the condensed water, flowing along the inner peripheral surface of the water collecting portion 44, continuously flows along the inner peripheral surface of the connecting portion 46 and thus, the water collecting path 54 for the collection of condensate water is formed at the inner peripheral surface of the connecting portion 46.

In the supply unit 40 according to the above-described embodiment and other supply units according to alternative embodiments of the present invention that will be described hereinafter, the supply path 52 for the movement of steam and the water collecting path 54 for the collection of condensate water are separated from each other, and furthermore, are formed independently of each other, in order to prevent the condensate water from being introduced into the supply path 52 for the movement of steam. This can consequently prevent against discharge of the condensate water via the supply unit 40.

Figure 4:
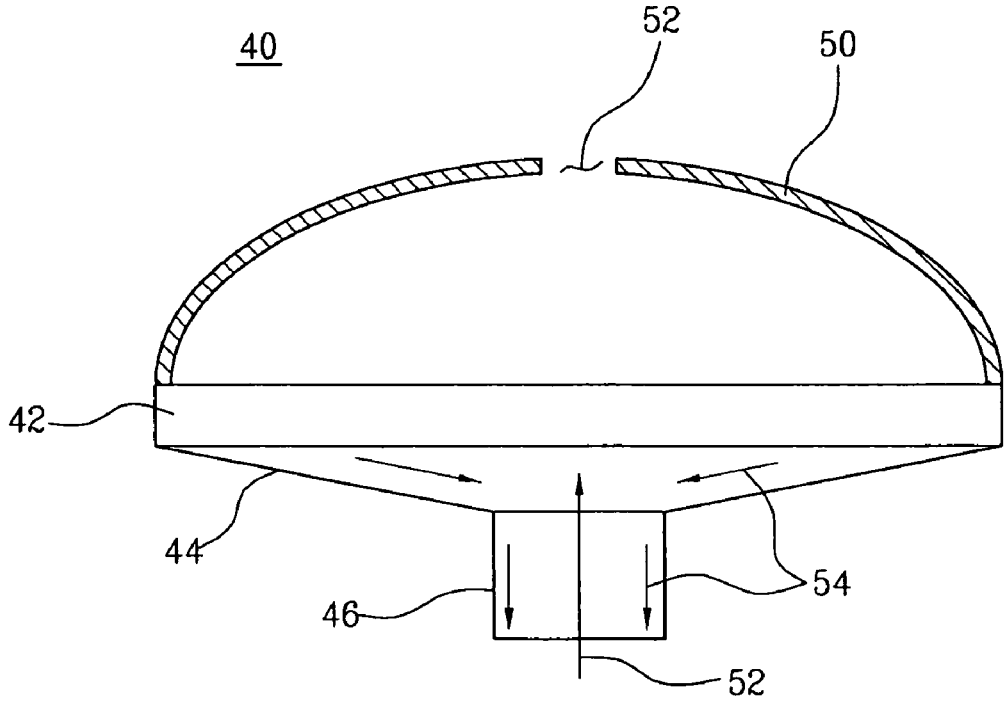
FIG. 4 is a schematic view illustrating the supply unit shown in FIG. 3, to which a cover is additionally installed.

FIG. 4 is a view illustrating the supply unit 40 shown in FIG. 3, to which a cover 50 is additionally installed. In FIG. 4, for convenience of description, only the cover 50 is illustrated in sectional view. The supply unit 40 according to the present embodiment may further include the cover 50, which is provided at the top of the supply portion 42 to provide cover to the supply portion 42.

The cover 50, which is provided at the top of the supply portion 42, has an opening 52, through which steam may be supplied, and the condensed water flows along an inner peripheral surface of the cover 50 to thereby be drain and be collected in the water collecting portion 44. Specifically, the steam, which will be supplied from the supply portion 42 into the accommodating space 12, may be supplied into the accommodating space 12 through the opening 52 of the cover 50. The water, condensed from the steam, flows along the inner peripheral surface of the cover 50, to thereby be collected in the water collecting portion 44.

Providing the cover 50 over the front side of the supply portion 42 may act to prevent discharging of the condensed water into the accommodating space 12 while the steam is being supplied.

Figure 5:
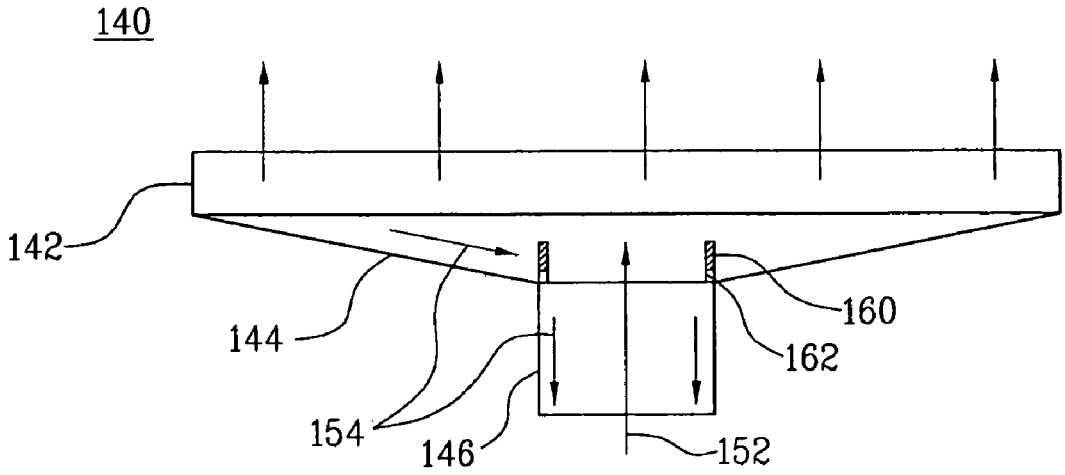
FIG. 5 is a schematic view illustrating a configuration of a supply unit according to a second embodiment.

FIG. 5 is a view schematically illustrating the configuration of a supply unit provided in the clothes treating apparatus according to a second embodiment of the present invention.

Referring to FIG. 5, the steam supply unit 140 according to the second embodiment is different from the first embodiment of FIGS. 3 and 4 in that the water collecting portion 44 is provided with a storage barrier 160. Hereinafter, the second embodiment will be described on the basis of the above difference.

In the embodiment shown in FIGS. 3 and 4 in which the water collecting path 54 is formed at the inner peripheral surfaces of the water collecting portion 44 and the connecting portion 46, if there exists a small amount of condensed water, it will flow along the water collecting path 54. However, if there exits a large amount of condensate water, there is a likelihood of the condensed water being introduced from a connecting region between the water collecting portion 44 and the connecting portion 46 into the center of the connecting portion 46, thereby being supplied into the supply path 52. When the condensed water is heavily flowing into the connecting portion, the condensed water may interfere with the steam supply path 52, thus the condensed water may be inadvertently supplied into the accommodating space 12 together with the steam.

Accordingly, to solve the above-described problem, in the embodiment of FIG. 5, a storage barrier 160 is formed at a water collecting portion 144, to temporarily obstruct and control the flow of the condensed water, so as to allow only a desired amount of condensed water into a connecting portion 146.

More specifically, the storage barrier 160 protrudes from the water collecting portion 144 toward the supply portion 142 by a desired height, and has holes 162 for allowing the condensed water to pass through the storage barrier 160. Accordingly, if a small amount of water is condensed in the water collecting portion 144, the condensate water flows through the holes 162 perforated in the storage barrier 160 without a risk of interfering with a supply path 152. On the other hand, even if a large amount of water is condensed in the water collecting portion 144, all of the condensed water may not pass through the holes 162 of the storage barrier 160. Consequently, only a part of the condensed water is permitted to flow through the holes 162 and the remaining condensate water is held back and stored by the storage barrier 160. Accordingly, a desired flow rate of the condensed water, is achieved which corresponds to a passage capacity of the holes 162 of the storage barrier 160. The condensed water that flows through holes 162 follows a water collecting path 154, and the remaining condensed water is temporarily held back and stored by the storage barrier 160.

In the above-described configuration, the amount of condensed water flowing along the water collecting path 154 may be manually adjusted according to a position of the storage barrier 160 and a size of the holes 162. Although the storage barrier 160 may be formed at a freely selected position of the water collecting portion 144, it is preferred that the storage barrier 160 be formed adjacent to the connecting portion 146. This can increase the amount of condensate water to be stored by the storage barrier 160. Furthermore, the storage barrier 160 may preferably be of a height sufficient to hold back a predetermined amount of condensed water, while still allowing the steam entering along steam supply path 152 to be properly distributed throughout the interior of the nozzle and to be properly dispersed as it exits the nozzle into the accommodating space 16.

In addition, the amount of condensate water passing through the holes 162 may be adjustable according to a size of the holes 162. The size of the holes 162 is not limited, and it is preferred that the condensed water flows along the inner peripheral surfaces of the water collecting portion 144 and the connecting portion 146 without a risk of being supplied into the supply path 152. More preferably, the holes 162 are formed close to a lower end of the storage barrier 160, i.e. close to the connecting portion 146. The longer the spacing distance between the holes 162 and the connecting portion 146, the greater the risk of the condensate water sputtering after passing through the holes 162, thereby being problematically supplied into the supply path.

Figure 6:
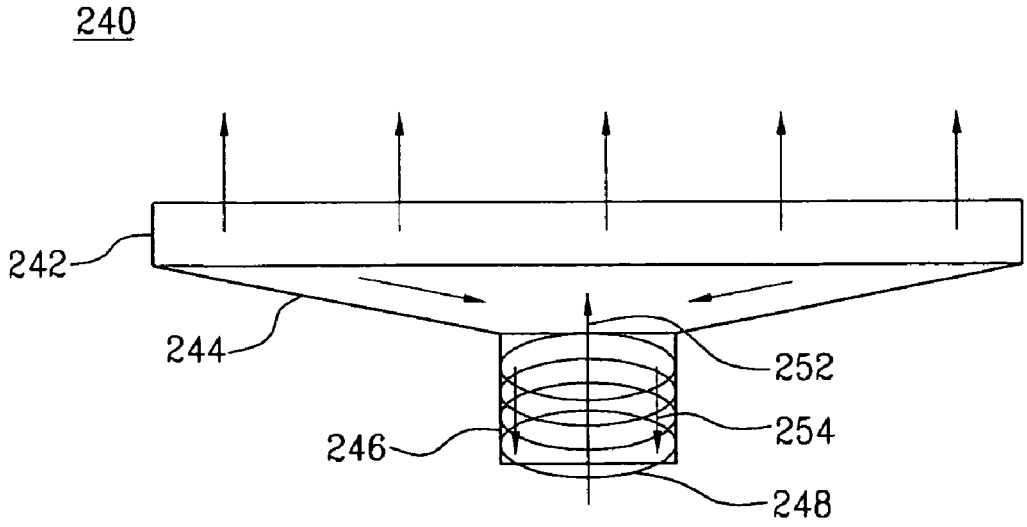
FIG. 6 is a schematic view illustrating a configuration of a supply unit according to a third embodiment.

FIG. 6 is a view schematically illustrating a configuration of a supply unit provided in the clothes treating apparatus according to a third embodiment of the present invention.

Referring to FIG. 6, the supply unit 240 according to the third embodiment is different compared to the above-described embodiments in that a guide is provided at an inner peripheral surface of a connecting portion 246, to guide the flow of condensed water. The guide serves to prevent the condensed water, flowing along the inner peripheral surface of the connecting portion 246, from sputtering toward the center of the connecting portion 246.

Specifically, in the present embodiment, the guide takes the form of a spiral groove 248 formed at the inner peripheral surface of the connecting portion 246 for guiding the flow of condensed water. Accordingly, once the condensed water is supplied into the connecting portion 246 after flowing along an inner peripheral surface of a water collecting portion 244, the condensed water continuously flows along the spiral groove 248 formed at the inner peripheral surface of the connecting portion 246 without risk of the condensed water sputtering or splashing into a supply path 252 defined in the center of the connecting portion 246.

Figure 7:
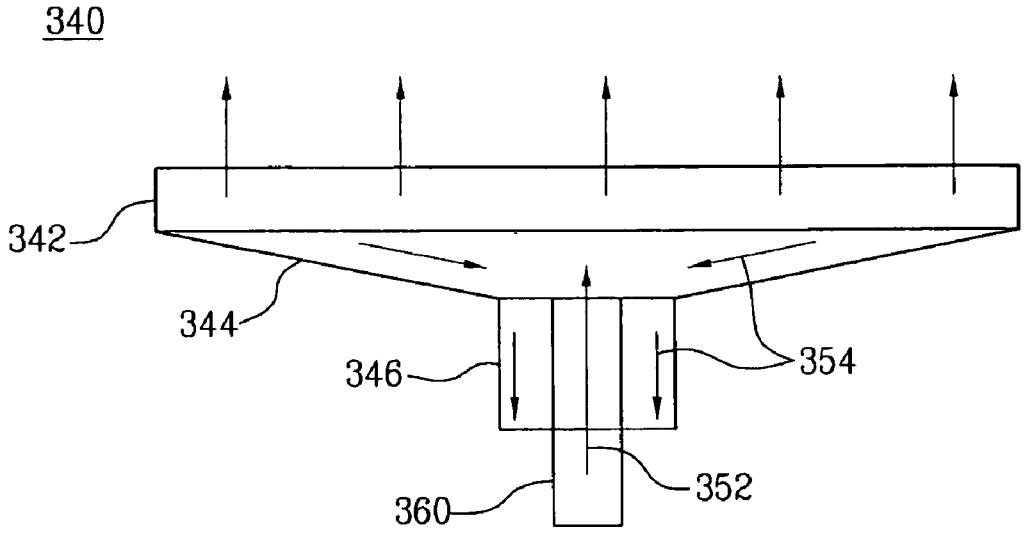
FIG. 7 is a schematic view illustrating a configuration of a supply unit according to a fourth embodiment.

FIG. 7 is a view schematically illustrating a configuration of a supply unit provided in the clothes treating apparatus according to a fourth embodiment of the present invention.

Referring to FIG. 7, the supply unit 340 according to the fourth embodiment is different form the above-described embodiments in that it further includes a steam supply hose 360, which extends into the steam hose 36 of the steam generator 30 and internally defines a steam supply path 352 to supply steam into a supply portion 342 of the supply unit 340.

Specifically, in the present embodiment, to prevent the condensate water from sputtering into the supply path 352 defined in the center of the connecting portion 346, the steam supply hose 360 for the supply of steam is penetrated through the interior of the steam hose 36 and the connecting portion 346. The upper end of steam supply hose 360 may be flush with an upper end of connecting portion 346 (FIG. 7) or extend above the upper end thereof (not shown) so to further isolate the steam supply path 352 from a water collecting path 354.

Accordingly, the steam generated in the steam generator 30 is supplied into the supply portion 324 through the interior of the steam supply hose 360, thereby being ejected into the accommodating space 12. Also, the water, condensed in a water collecting portion 344 and the connecting portion 346, flows along the water collecting path 354 defined between an outer periphery of the steam supply hose 360 and the inner periphery of the steam hose 36, thereby being returned into the steam generator 30. In conclusion, in the present embodiment, the steam supply hose 360 defining the supply path 352 is additionally provided, whereby the supply path 352 and the water collecting path 354 are separated from each other and furthermore, are formed independently of each other. This may act to isolate the steam supply path 352 and prevent the condensed water from sputtering into the supply path 352.

Figure 8:
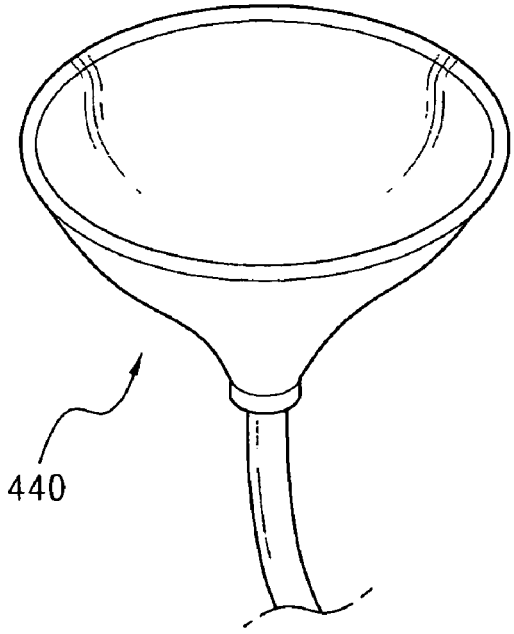
FIG. 8 is a perspective view illustrating an alternative configuration of the supply unit shown in FIG. 2.

FIG. 8 is a perspective view illustrating an alternative configuration of the supply unit 40 shown in FIG. 2.

In FIG. 2, although the supply portion 42 of the supply unit 40 has a longitudinally elongated shape, the supply unit is not limited to the above-described shape and may be formed into various shapes. For example, as shown in FIG. 8, the supply unit may have a circular or elliptical supply portion 440, or other polygonal shapes of a supply portion.

It is noted that the above described shape of the supply portion is applicable to all the above-described embodiments of the present invention. For example, when the above described shape of the supply portion is applied to the embodiment of FIG. 5, the storage barrier 160 may be configured to surround the connecting portion of the supply unit.

Figure 9:
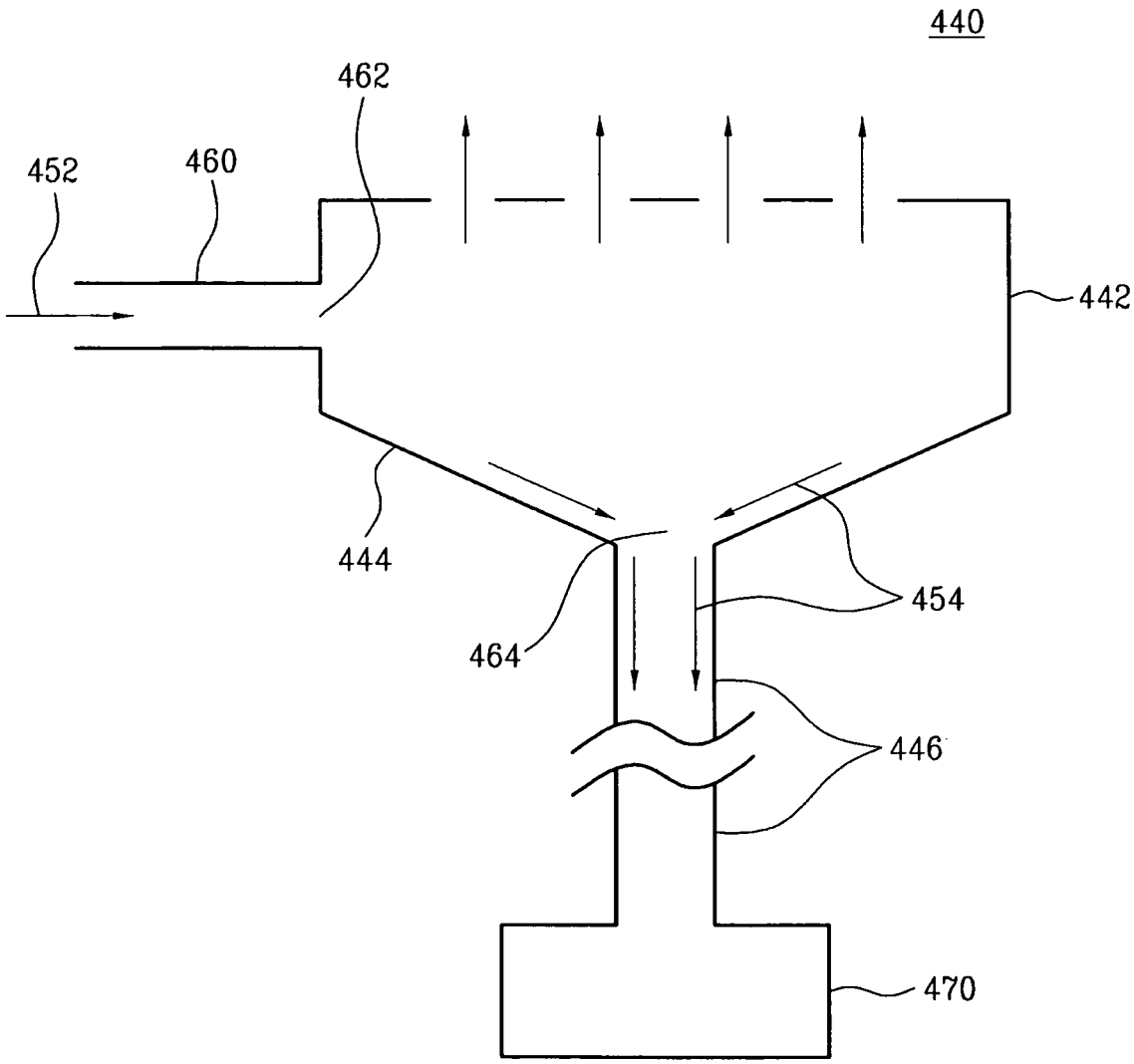
FIG. 9 is a schematic view illustrating a configuration of a supply unit according to a fifth embodiment.

FIG. 9 is a schematic view illustrating a configuration of the supply unit provided in the clothes treating apparatus according to a fifth embodiment of the present invention. As illustrated in FIG. 9, the supply unit 440 according to the fifth embodiment is different from the above-described embodiments in that it further includes a steam supply hose 460, which is physically separated from and no longer co-located with the water collecting hose 446. This exemplary configuration allows the steam to flow into a supply portion 442 without the potential for interference with condensed water flowing along a water collecting path 454.

In the embodiment of FIG. 9, the steam may be generated in the steam generator 30 and flow through the steam supply hose 460, thus entering the steam supply portion 442 at a side thereof through a steam introduction port 462. As the steam enters into the supply portion 442 it may be supplied into the interior of the accommodating space 12 to treat clothing 1 placed therein. Additionally, condensed water may form at the interior of the supply portion 442. The condensed water, thus, may form and thereafter flow along water collecting path 454 and into opening 464. After exiting the supply portion 442 via opening 464 the condensed water follows along water collecting hose 446. The water collecting hose 446 may guide the water directly back to the steam generator (not shown), to a sump 470, to an external drain (not shown), or the like.

It is preferable that the steam introduction port 462 be located above water collecting hose 446. By providing steam supply hose 460 and steam introduction port 462 above water collecting hose 446, the steam entering supply portion 442 will be permitted to naturally flow upward into the accommodating space 12 without interference from the water that is condensed in the supply portion 442. This exemplary embodiment, by lessening the potential for interference between the steam supply path 452 and the water collecting path 454, likewise lessens the potential of condensed water entering into the accommodating space 12.

In all the above-described embodiments, the condensed water, collected by the supply unit, may be returned into the steam generator 30, or may be returned into an additionally provided water collecting unit, such as a container or a sump (not shown). Specifically, the condensed water collected by the supply unit may sequentially pass through the water collecting portion and the connecting portion of the supply unit and the steam hose 36 of the steam generator 30, to thereby be returned into the steam generator 30. The condensed water, returned into the steam generator 30, may be heated later if additional steam is necessary.

Meanwhile, the clothes treating apparatus according to the above-described embodiments of the present invention may further include a water collecting unit (not shown) for receiving the collected water condensed in the air supplier 22. The water collecting unit may take the form of a sump provided in the mechanism compartment 20. Thereby, the water condensed in the air supplier 22, may be collected into and received in the water collecting unit, to allow a user to easily dispose of the condensed water collected in the water collecting unit. When providing an additional water collecting unit the condensed water collected by the supply unit can be received in the water collecting unit. For example, a drainage hole may be formed at a distal end of a water collecting path defined in the steam hose 36, and a hose may be provided to connect the drainage hole to the water collecting unit, so as to collect the condensed water in the water collecting unit.

Although the above-described embodiments are described as discrete concepts, the respective embodiments may be combined with one another. For example, a combined supply unit of the second, third, and fourth embodiments, a combined supply unit of the third and fourth embodiments, or a combined supply unit of the second and fourth embodiments is of course envisioned.

Hereinafter, operation of the clothes treating apparatus having the above-described configuration will be described with reference to the accompanying drawings.

Upon operation of the cloth treating apparatus 100, first, water is supplied from a water supply source into the steam generator 30 to generate steam, and the steam is introduced into the accommodating space 12. In this case, water condensed from the steam, may be returned, along a water collecting path, into the steam generator or additionally provided water collecting unit, and it is possible to prevent the condensate water from being supplied into the accommodating space 12. In the cloth treating apparatus, introduction of the steam can remove wrinkles, etc. from clothes, and achieve swelling and sterilizing effects of clothes.

After the steam is ejected for a desired time, hot air is supplied via the air supplier 22. Specifically, the air supplier 22 dehumidifies and heats air, to supply the resulting dry and hot air into the receiving space 12.

If clothes are completely dried by the hot air, the supply of hot air is stopped and the freshening operation of the clothes is completed.

The present invention provides a clothes treating apparatus in which an air supplier is provided, thereby achieving a considerably reduced consumption of electric energy and effective freshening of clothes, as compared to the prior art.

Further, according to the present invention, during the supply of steam, condensate water condensed from the steam can be collected, and it is possible to prevent the condensate water from being ejected into a clothes receiving space.

What is claimed is:

1. A clothes treating apparatus comprising:

a cabinet defining an accommodating space adapted to receive clothes;

a steam generator adapted to generate steam to be supplied into the accommodating space from the steam generator;

a supply unit including at least one opening adapted to disperse steam into the accommodating space, wherein the supply unit comprises:

a supply portion from which the steam is ejected;

a water collection portion having a water collecting path disposed at an inner peripheral surface thereof adapted to collect the condensed water and guide condensed water formed in the supply unit;

a connecting portion having a steam supply path defined in the center of the connecting portion along which the steam is introduced into the supply portion, and a water collecting path defined along an inner peripheral surface of the connecting portion along which the collected condensed water flows; and a storage barrier extending from one side of the water collecting portion to prevent a portion of the condensed water from flowing, the storage barrier having a hole through which the condensed water may pass.

2. The apparatus according to claim 1, wherein the storage barrier is formed adjacent to the connecting portion, and the condensed water, having passed through the hole, flows along the water collecting path defined along the inner peripheral surface of the connecting portion.

3. The apparatus according to claim 1, wherein the supply unit further comprises a guide defining the water collecting path at the inner peripheral surface of the connecting portion to guide flow of the condensed water.

4. The apparatus according to claim 3, wherein the guide comprises a spiral groove formed at the inner peripheral surface of the connecting portion.

5. The apparatus according to claim 1, wherein the supply unit further includes a steam supply hose extending from the steam generator and disposed in the connecting portion, the steam supply hose defining a supply path through which the steam is supplied into the supply portion.

6. The apparatus according to claim 3, wherein the supply unit further includes a steam supply hose extending from the steam generator and disposed in the connecting portion, the steam supply hose defining a supply path through which the steam is supplied into the supply portion.

7. The apparatus according to claim 5, wherein the steam supply hose and the connecting portion are disposed concentrically with respect to one another.

8. A clothes treating apparatus comprising:

a cabinet defining an accommodating space adapted to receive clothes;

a steam generator adapted to generate steam to be supplied into the accommodating space from the steam generator;

a supply unit including at least one opening adapted to disperse steam into the accommodating space, wherein the supply unit comprises:

a supply portion from which the steam is ejected;

a water collection portion having a water collecting path disposed at an inner peripheral surface thereof adapted to collect the condensed water and guide condensed water formed in the supply unit;

a connecting portion having a steam supply path defined in the center of the connecting portion along which the steam is introduced into the supply portion, and a water collecting path defined along an inner peripheral surface of the connecting portion along which the collected condensed water flows; and a guide defining the water collecting path at the inner peripheral surface of the connecting portion to guide flow of the condensed water, wherein the guide comprises a spiral groove formed at the inner peripheral surface of the connecting portion.

9. The apparatus according to claim 8, wherein the supply unit further includes a steam supply hose extending from the steam generator and disposed in the connecting portion, the steam supply hose defining a supply path through which the steam is supplied into the supply portion.

* * * * *